United States Patent [19]

Guiraud

[11] 4,296,618

[45] Oct. 27, 1981

[54] LOCK AND KEY DEVICE

[75] Inventor: Francois Guiraud, Chambourcy, France

[73] Assignee: Fichet-Bauche, Velizy, France

[21] Appl. No.: 974,557

[22] Filed: Dec. 29, 1978

[30] Foreign Application Priority Data

Dec. 30, 1977 [FR] France ..... 77 39747

[51] Int. Cl.[3] ..... E05B 19/02; E05B 29/02

[52] U.S. Cl. ..... 70/358; 70/401; 70/407; 70/364 R

[58] Field of Search ..... 70/419, 401, 366, 429, 70/410, 358, 423, 395, 407, 364 R, 364 A, 409, 406

[56] References Cited

U.S. PATENT DOCUMENTS 2,685,192 8/1954 Salle ..... 70/358
4,018,069 4/1977 Lipschutz ..... 70/395

FOREIGN PATENT DOCUMENTS 40879 1/1924 Norway ..... 70/410

*Primary Examiner*—Robert L. Wolfe
*Attorney, Agent, or Firm*—Staas & Halsey

[57] ABSTRACT

Lock and key device with the lock comprising a barrel for driving at least one bolt, rotatably mounted in a fixed hollow shaft and containing fittings the cooperation of which with wing couples formed on the key in its operational portion unblocks the barrel relative to the shaft as to a rotary movement when the key is completely driven-in, means being provided in the lock and on the key for limiting the driving-in of the key inside the lock to the unblocking position of the fittings, a longitudinal undeceiver of the key cooperating with a barrel slot, distinguishing a wing couple from another wing couple for the introduction in a correct position of the key inside the lock. The undeceiver depends without discontinuity from a cylindrical rib provided in front of the connecting portion of the key ring with the operational portion, the front transverse wall of the shaft being formed with a conjugated traverse of the rib for preventing, through cooperation with the latter, the rotation of the key as long as it is not in its completely driven-in position where the rib escapes from the traverse, the rib being disposed for cooperation through its rear face, as soon as the rotation of the key is started, with the shaft plate for preventing the extraction and through its front face with the barrel, for providing the accuracy of the longitudinal position of the key relative to the fittings contained in the barrel.

3 Claims, 12 Drawing Figures

LOCK AND KEY DEVICE

The present invention relates to a lock and key device.

Locks are known which comprise inside a barrel a plurality of fittings for cooperation with the longitudinal edges of the wings formed in the operational portion of a key, so that when the key is completely driven-in in the barrel, the fittings are in positions corresponding to the so-called unblocked condition wherein the barrel may be rotated by the key, whereby the bolt or bolts included in the lock or controlled by the lock are driven in or out.

Such locks which operate satisfactorily and are well-tried are used more and more for operating locks with several bolts. Particularly in the latter case, the rotation resistance offered by the barrel may become very important and this entails the risk, in extreme circumstances, of breaking the key. Up till now, such breakings set serious problems since the extraction of the key portion left inside the lock is very difficult and calls for the intervention of a specialist.

The object of the invention is a lock and key device wherein such a key breaking is not a serious drawback.

In this respect, the invention is characterized in that the connection portion between the key body housed in the barrel and the key ring which remains outside the lock is shaped so that its cross-section of lesser mechanical strength is outside the lock when the key is completely driven-in.

Under such conditions, if due to a break the key ring is severed from the rest of the key, a fraction of the connection portion remains protruding outside the lock so that it is easy, by using simple pliers, to extract the key portion housed inside the barrel, this operation being possible for the user.

In a lock and key device of the hereabove mentioned type, there is provided for distinguishing a couple of wings, the wings of which in the prolongation of each other are situated on either side of the core, from the other wing couple the wings of which have an identical appearance as the first couple, a longitudinal rib, or "undeceiver", continuing the core beyond one of the wing couples, whereby a slot corresponding to the rib is provided in the barrel. The fixed shaft, or jacket, in which is housed the barrel is also formed, on the periphery of the key introduction passage provided in its rear plate, with a slot corresponding to said rib.

Till now, the undeceiver is formed with a free cross-section at its rear end at the side of the ring, so that the rotation of the key in the lock is prevented as long as the key is not in its complete introduction position, in which position the free section has passed the rear plate, thereby permitting the rotation of the key. During the rotation, said free section rubs against the inner face of the rear plate, which is made of a hard material, and against which it is urged by the user. After a number of operations, and since the section has a very small surface, there appears a slight shortening of the undeceiver, and the precision of the positioning of the key relative to the fittings in the barrel deteriorates due to wear.

The invention provides in this respect that the undeceiver depends directly from a transverse abutment projection, the key being maintained in the longitudinal direction while rotating by the cooperation of the rear face of the projection with the inner face of the shaft rear plate.

The projection is formed with a surface far greater than that of the undeceiver cross-section of a standard key, so that the wear is not noticable in spite of very many operations. The exact positioning of the key in the barrel remains ensured even after prolonged usage of the key.

The absence of free cross-section still reinforces the key solidity.

In the following description which is given as examplification, reference is being made to the accompanying drawings wherein.

Figures 1, 2, 3, 4:
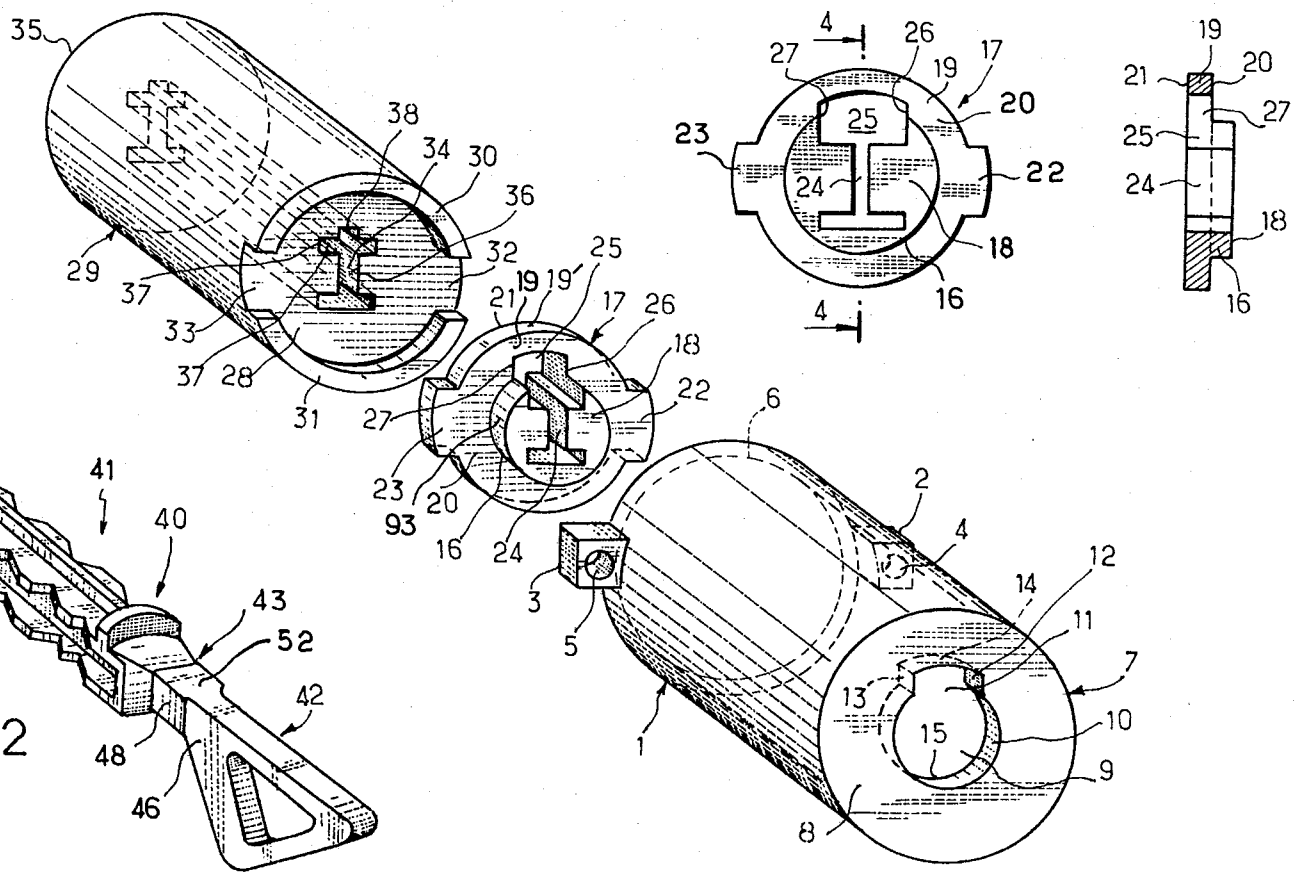
FIG. 1 is an exploded perspective view of the barrel, the barrel nose and the shaft of the lock according to the invention.
FIG. 2 is a perspective view of the key according to the invention.
FIG. 3 is a front view as seen from the rear face of the barrel nose of the lock according to the invention.
FIG. 4 is a cross-sectional view along line 4—4 of FIG. 3.
Figure 7:
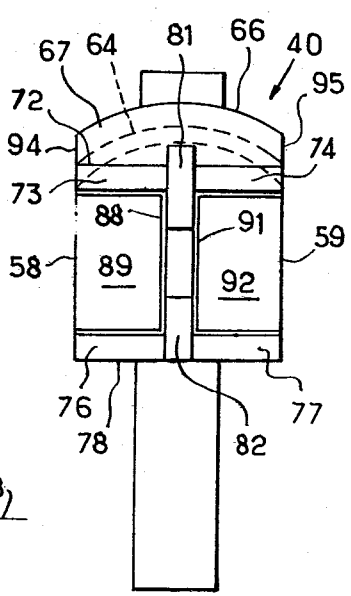
FIG. 7 is a front view of the end opposite the ring.

The shaft 1 or jacket (FIG. 1) is a hollow cylindrical part made from a hard metallic material, fixed for example to the door leaf (not shown) through ears 2 and 3 diametrically opposite depending from the jacket of the cylindrical shaft in the vicinity of its front edge 6. The ears are formed with holes 4 and 5 for the passage of shaft fixation screws. The rear plate 7 of the shaft 1 is limited by a rear surface 8 and is formed in it center with a hole 9 substantially circular limited by a cylindrical surface 10. The hole 9 is formed in its upper portion with a cutout 11 bounded by side faces 12 and 13, plane and parallel and by a cylindrical surface 14 of same axis as the cylindrical surface 10 of hole 9, and which forms also the shaft axis. The inner surface 15 of plate 7 is parallel to the outer on rear surface 8 of the plate.

In the hole 9 of shaft 1 is housed a boss 16, cylindrical, carrying in its centre a barrel nose 17 (FIGS. 3 and 4). The length of boss 16 is substantially equal to the thickness of the rear plate 7, or somewhat smaller, as shown, so that the rear face 18 of the boss comes flush with the surface 8 of the shaft rear plate, or is slightly standing back. The body 19 of the barrel nose 17 is a cylindrical ring of relatively small length. It is limited by two parallel faces 20 and 21 perpendicular to its longitudinal axis, the cylindrical boss 16 depending of face 20. Body 19 is formed with two ears 22, 23 diametrically opposite, of same thickness as body 19 and projecting on the edge of the latter. The outer diameter of body 19 of barrel nose 16, in the region of its ears, is such that it does not impede the introduction of the barrel nose body inside shaft 1.

The barrel nose 17 formed by body 19 and boss 16 comprises a hole 24 for the passage of the key and generally shaped as an H, the medium bar of which is vertical and one of its two branches, the upper horizontal branch as shown in FIG. 1, comes and interrupts the cylindrical surface of boss 16. The hole 24 for the passage of the key is completed by a cut-out 25 formed in body 19 and the faces 26 and 27 of which continue, in body 19, the vertical faces of the upper horizontal branch of the H-shaped hole of the cylindrical boss 16.

The barrel nose 17 comes to bear with its front face 21 against the rear face 28 of a cylindrical barrel 29 housed inside shaft 1. The plane face 28 is bounded by two almost semi circular projections 30 and 31 forming between themselves two notches 32 and 33 for receiving the ears 22 and 23 of the barrel nose, and which, when the barrel nose 17 is applied against face 28, make the nose and the barrel integral in rotation with each other.

The barrel 29 comprises in its inside portion in a conventional manner a set of fittings (not shown) as well as one or two catches (also not shown). Barrel 29 is formed with a longitudinal hole 34 for the passage of the key, emerging on face 28 and on the front face 35, the hole having a H-shaped cross-section, the transverse bar of which is disposed vertically, the bar 36 being continued beyond the upper branch 37 by a slot 38 of small height.

Figure 5:
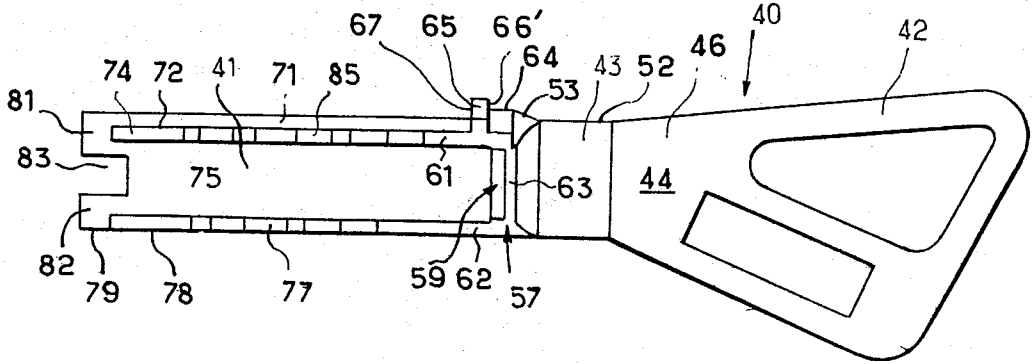
FIG. 5 is a side view of a key according to the invention.
Figure 6:
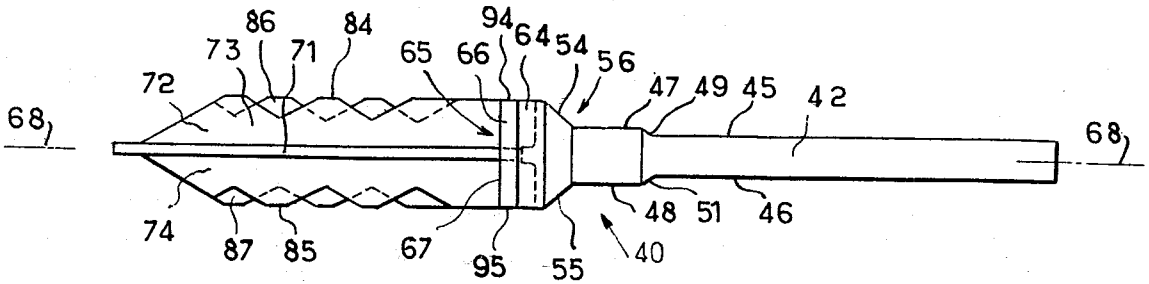
FIG. 6 is a top view of the key of FIG. 5.
Figure 8:
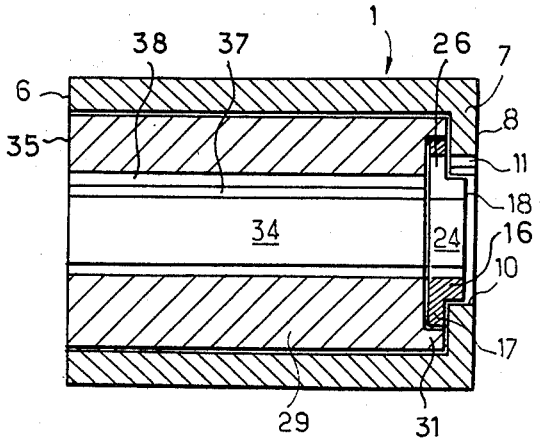
FIG. 8 is a view of the barrel and barrel nose housed in the shaft of the lock according to the invention, in axial cross-section along line 8—8 of FIG. 9.
Figure 9:
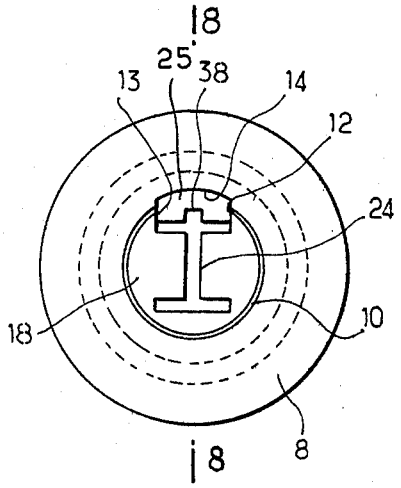
FIG. 9 is a front view of the shaft and barrel nose.
Figure 10:
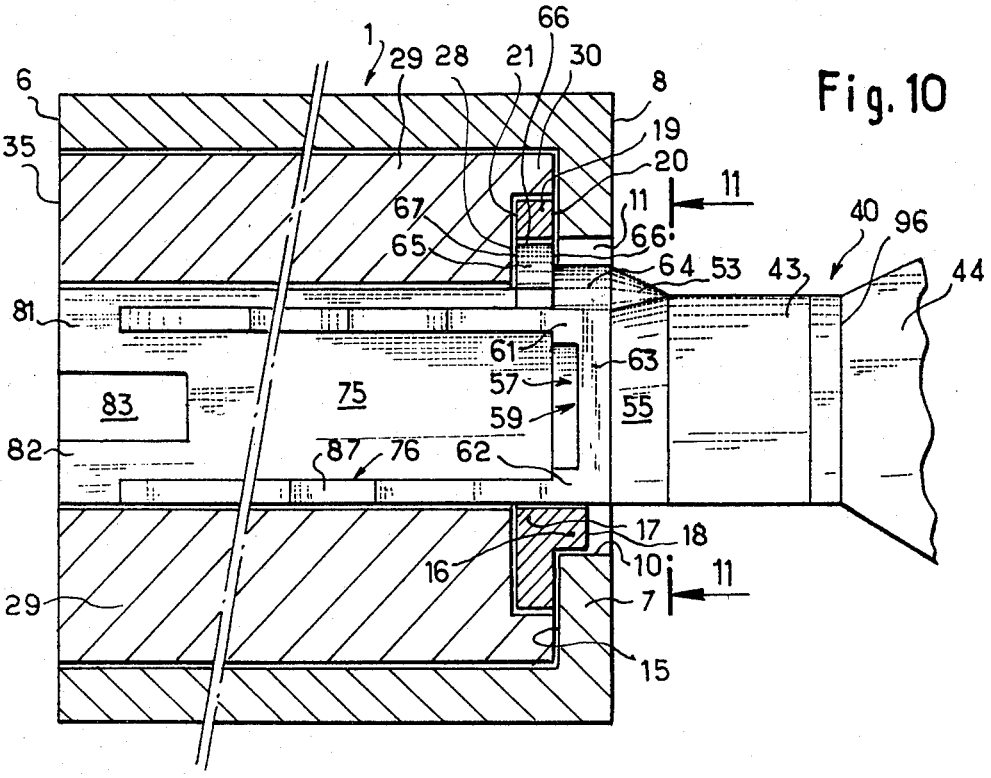
FIG. 10 is a longitudinal cross-section at a larger scale of a lock and key device according to the invention, the key being introduced into the lock in its maximum driven-in position and before rotating the key.
Figure 12:
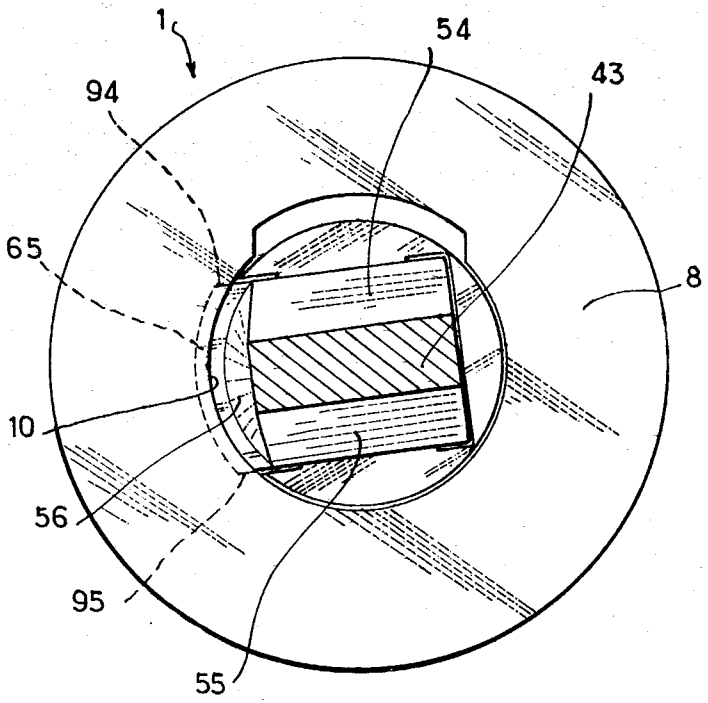
FIG. 12 is a similar view to FIG. 11 but after rotation of the key.
Figure 11:
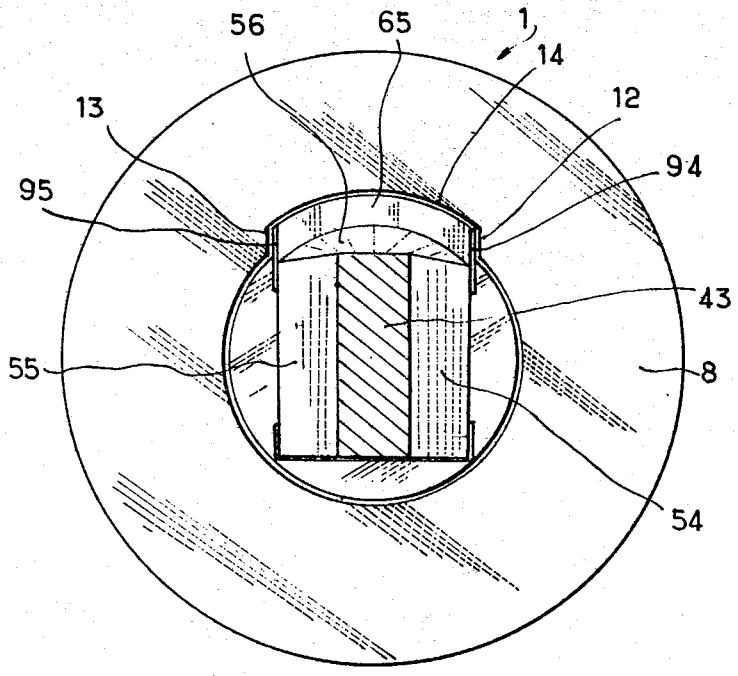
FIG. 11 is a cross-sectional view along line 11—11 of FIG. 10.

In the key passage formed by the alignment of the barrel nose and the barrel can be introduced a key 40 (FIGS. 2, 5, 6 and 7). The key comprises an operational portion 41 connected to a key ring 42 through a parallelepipedic connection 43. The key ring 42 has in the example the general shape of a triangle with unequal sides, truncated at its most acute angle, although it may present of course any other shape. In its portion 44 which is close to the connecting portion 43 with the key body, the key ring has a rectangular cross-section. Its parallel faces 45 and 46 are less remote from each other than faces 47 and 48 which are parallel to them from the connection portion 43, and to which they are connected through fillets 49 and 51 respectively. The upper face 52 (as seen in FIG. 5) of the connecting portion 43 is substantially plane. It is continued in the direction of the key body 41 by a frustoconical surface 53 fitting with the rear faces 54 and 55 of two side shoulders 56 and 57. The side faces 58 and 59 of the latter are plane and U-shaped with two parallel branches 61 and 62 connected by a bar 63. The frustoconical surface 53 is continued by a cylindrical surface 54 ending forwardly with a rib 65 having a cylindrical outer surface 66, coaxial with the cylindrical surface 64 and having rear faces 66' and front faces 67 which are plane, perpendicular to the medium plane 68 of the key.

From the front plane surface 67 depends a longitudinal ribs 71, or undeceiver, extending along the upper surface 72 of the connecting portion of the two rings 73 and 74, forming an upper couple of wings and extending from the flat body 75 of the key. The wings 76 and 77 forming the lower couple of wings have their lower face 78 in the prolongation of the lower edge 79 of body 75, the thickness of the body being that of the undeceiver 71. The body 75 ends with rectangular teeth 81, 82 spaced apart by an interval 83. The wing edges, respectively 84, 85 and 86, 87, have the usual sizes for cooperation with the fittings. At the rear portion, the vertical face 88 of body 75 is connected with the transverse plane face 89 of shoulder 56 and the opposite face 91 of body 75 is connected with the plane transverse face 92 of shoulder 57.

The operation is as follows:

The key 40 is introduced into the lock in the usual manner, by presenting its front end facing hole 9 of the rear plate of shaft 1, in register with the passage hole for key 24 of the barrel nose 17 and of the passage hole 36 of barrel 29 continuing passage hole 24.

The presence of the upper portion of the key of rib 71, or undeceiver, provides the introduction of the key in the key passage hole of the barrel only when the key is presented in the good orientation, that is the orientation where said undeceiver 71 slides inside slot 38 of the passage hole of key 36 in barrel 29.

The introduction of the key 40 is stopped by the abutment of its transverse faces 89 and 92 of shoulders 56 and 57 against the front face 18 of boss 16 carried by the barrel nose 17. In this position, the cuttings of the key wings cooperate appropriately with the barrel fittings, the effect thereof being to unblock the rotation of barrel 29 relative to shaft 1. By rotating the barrel with the key, one controls by means of a known mechanism the driving in or out of the lock bolt or bolts.

In the final phase of the introduction of the key, the curved transverse rib 65 is introduced first in the cut-out 11 bordering hole 9 of the rear face of the shaft and no rotation of the key is possible; thereafter, the rib sits inside notch 25 formed in the barrel nose 17. As long as the front face 67 of the rib is not engaged with the rear face 28 of barrel 29, corresponding to the total introduction of the key, the rotation of the key is impossible due to the cooperation of one of the side faces 94 and 95 of rib 65 with faces 12 and 13 of the cut-out 11. When the rib 65 extends completely through the plate 7 of shaft 1, the key is no more stopped by the side faces 12 and 13. In this state of complete introduction, the cylindrical surface 66 of the key completes the cylindrical surface 93 of the boss 16 formed on the barrel nose 17. In this position where the barrel is unblocked, it is possible to obtain the rotation of the barrel through the rotation of the key.

A small rotation of the key causes an angular displacement of rib 65 relative to the cut-out 11. The rear face 66' of the rib cooperates slidably with the inner face 15 of the shaft wall 8, whereby the key is prevented from being taken out of the lock as long as the key has not been rotated over a complete turn. During this rotation, the cuttings of the key wings remain exactly positioned relative to the fittings due to the cooperation on the one hand of the rear face 66' of rib 65 against the inside face 15 of plate 7 of shaft 1 and on the other hand to the cooperation of the front face 67 of the rib against the rear transverse surface 28 of barrel 29 which partakes to the rotation. The cooperation of the transverse face 66' with the fixed surface 15 is such that there is no noticeable wear due to the large size of rib 65. Thus, the lock may be operated a considerable number of times without the precision of the positioning of the key relative to the fittings loosing accuracy. A contribution to the guiding of the rotary movement of the key is provided by the cooperation of the cylindrical surface 64 of the key with the cylindrical surface 10 of hole 9 in the casing plate 7. If, for any reason, a too violent effort is exerted on the key once it has been introduced in the lock, for instance after an excessive resistance of the bolt or bolts for an extraction or retraction movement, the key, the operational portion of which is maintained by the bolt and the barrel nose, may break, but the break appears in its area of lesser mechanical strength which is the common portion 96 between area 44 of the key ring and the connecting portion 43 which is outside the lock.

After such a break, it is easy to remove the key still remaining inside the lock by taking it with pliers in the connecting portion 43 projecting outside the lock.

I claim:

1. A lock and key device, with the key comprising two pairs of slotted wings and the lock comprising a fixed hollow shaft with a rear traverse wall having a notching for the passage of the key, inside the fixed hollow shaft a rotary barrel with a rear partition provided with a conjugate slot of the key profile and interposed between the rotary barrel and the fixed hollow shaft coupling means which can only be rotated when the key has reached a driven-in position which is predetermined by a stop, a housing in back of the rear partition of the rotary barrel provided by extensions thereon, a cylindrical ring complementary to said housing extensions through external ears, a passage in said cylindrical ring of the key profile and having an internal slot with the same width as the wings; said key having, in addition to the slotted wings, on a connecting portion between the wings of one pair and a body of the key a projecting part with the same conjugate shape as said internal slot of the cylindrical ring so that when the key, after being driven into place, is under load stress to make a rotative motion, it will rotate the assembly made up of the ring and the rotary barrel through cooperation of one lateral face of its projecting part with a face opposite the slot, and the other face of the projecting part cooperating, through sliding during the rotative motion, with the front face of said rear traverse wall of the fixed hollow shaft so as to prevent the key from being withdrawn as long as it has not made a complete turn.

2. In combination a lock and key device; the key having two pairs of slotted wings and the lock comprising a fixed hollow shaft with a rear wall having a notching for the passage of the key, inside the fixed hollow shaft a rotary barrel having a rear partition provided with a conjugate slot of the same profile as the key, coupling means interposed between said rotary barrel and the fixed hollow shaft which can only be rotated when the key has reached a driven in position as predetermined by a stop, a housing in back of the rear partition of the rotary barrel provided by extensions on said barrel thus forming notches therebetween, a cylindrical ring with external ears engageable with said notches between the extensions thus forming said housing, a passageway in said cylindrical ring of the same profile as the key and furthermore having an internal slot of the same width as the key wings, said key having in addition to the slotted wings a projecting part on a connecting portion between one pair of wings and a body for the key, said projecting part provided with two lateral faces and having the same conjugate shape as said internal slot of the cylindrical ring so that when the key, after being inserted into place and under pressure to rotate will rotate the assembly made up of the cylindrical ring and the rotary barrel, and furthermore will through cooperation of one lateral face of said projecting part with a face opposite said internal slot of the cylindrical ring and the other face of the projecting part in cooperation with and through sliding rotative motion with a front face of said rear wall of the fixed hollow shaft to prevent the key from being withdrawn as long as it has not made a complete turn.

3. A lock and key device according to claim 2, in which a median rib is directly dependent from the front face of said projecting part of the connecting portion between the wings of said one pair and said key body, and which is furthermore designed to cooperate with a conjugate groove provided by said passageway in said rear wall of the fixed barrel for the purpose of preventing rotation of said key until it is fully inserted into the lock device.

* * * * *